United States Patent [19]

Heinroth et al.

[11] 4,030,278

[45] June 21, 1977

[54] HIGHLY ELASTIC CRIMP YARN

[75] Inventors: Karl-August Heinroth; Theo Dietrich; Hans Bach; Hans-Dieter Jurischka, all of Dormagen, Germany

[73] Assignee: Bayer Aktiengesellschaft, Leverkusen, Germany

[22] Filed: Jan. 13, 1975

[21] Appl. No.: 540,728

Related U.S. Application Data

[63] Continuation of Ser. No. 187,702, Oct. 8, 1971, abandoned.

[30] Foreign Application Priority Data

Oct. 8, 1970 Germany ..... 2049357

[52] U.S. Cl. ..... 57/34 HS; 57/157 TS

[51] Int. Cl.[2] ..... D01H 7/92; D02G 1/00

[58] Field of Search ..... 57/34 HS, 157 TS, 157 R, 57/134 R

[56] References Cited

UNITED STATES PATENTS

| | | | |
|---|---|---|---|
| 3,069,837 | 12/1962 | Olson | 57/34 HS X |
| 3,094,834 | 6/1963 | Deeley et al. | 57/157 TS X |
| 3,112,600 | 12/1963 | Stoddard et al. | 57/34 HS |
| 3,165,881 | 1/1965 | Moncuit et al. | 57/34 HS |
| 3,238,592 | 3/1966 | Killoran et al. | 57/34 HS X |
| 3,289,400 | 12/1966 | Scragg | 57/34 HS |
| 3,706,192 | 12/1972 | Liebbrand et al. | 57/157 TS |
| 3,724,191 | 4/1973 | Hooper et al. | 57/157 TS X |
| 3,724,196 | 4/1973 | Holland et al. | 57/157 TS X |

*Primary Examiner*—Donald E. Watkins
*Attorney, Agent, or Firm*—Plumley and Tyner

[57] ABSTRACT

Process and apparatus for producing highly elastic crimp yarn by the draw-texturing method using a false-twister, in which the filament speed exceeds 300 m/min and in which setting is carried out at constant filament tension by brief contact of the filament with a heating rail with roughened contact surface and a length of at most 400 mm.

2 Claims, 1 Drawing Figure

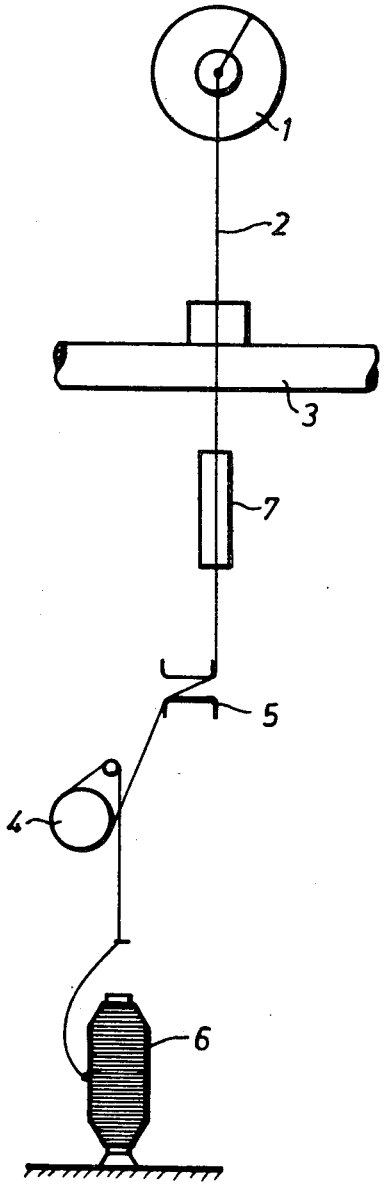
1
2
3
7
5
4
6

HIGHLY ELASTIC CRIMP YARN

This is a continuation, of application Ser. No. 187,702, filed Oct. 8, 1971, now abandoned.

The present invention relates to a process and apparatus for producing a highly elastic crimped yarn from synthetic endless filaments, using the false-twist method, in which filament speeds exceed 300 m/min and a shortened heating zone is used.

It is already known for highly twisted filaments to be continuously set by providing for long residence times of the filaments on a contact rail and cooling the filaments thereafter.

It is also known that, during conventional false-twist texturising using already drawn thermoplastic filaments, the required length of the heating zone depends on the texturising speed. A process in which the step of drawing or partial drawing is combined with false-twisting and setting is also known. In such a process, the initial yarn material is guided over feed rollers to a false-twisting unit in a stretchable condition and is removed therefrom by withdrawal rollers. The yarn is drawn or stretched on a neck (hot pin), which is arranged upwardly of the flow to the end section of a heater, by which the twisting within the drawing and false-twisting zone is set. In one described embodiment the working speed is given as 70.1 m/min., and the length of the heating zone is given as 61 cm. Also, a drawing texturising machine has been described which is essentially characterised in that it sets partially or fully stretched material, by false-twisting by means of internal friction twist-imparting devices, on a contact heating rail which has a length of more than 1 meter. It is an object of this invention to provide an improvement in the process for producing highly elastic crimped yarn the advantages of which will become apparent from the following description and the examples. This object is accomplished by an improvement in the process for the production of a highly elastic crimped yarn by stretch texturising using the false-twist method and setting a synthetic endless filament which comprises setting said filament at a filament speed of more than 300 m/min, said setting being carried out directly after the twist has been produced at a constant filament tension by brief contact between said filament and a contact heating zone which is at a temperature of from 150° to 210° C.

It is another object of this invention to provide an apparatus for carrying out the above process which comprises a supply unit of a stretch-texturising machine, a drafting roller, a friction twist-imparting unit and a contact heating rail, the spacing between the twisting unit and the heating rail being between 150 and 30 mm, the heating rail having a roughened contact surface and a length of at most 400 mm.

The contact heating rail preferably has a heated, slightly curved contact surface of which is roughened with a roughening depth of from 3 to 30 $m\mu$. In such apparatus, endless filaments of polyamide-6 can with advantage be efficiently texturised and can be set without the use of a separate cooling zone.

By means of the process according to the invention, the highest possible crimping values, i.e. crimp contraction and crimp stability, can be produced, the constant filament tension in the setting zone and at the entry and exit of the friction false-twist imparting device being a pre-requisite for a constant quality.

Another decisive advantage is that the heating rail can be shorter than 400 mm and is provided with a special roughening depth. This heating rail, which is substantially shorter than those known in the prior art, results in lower machine construction and running costs, because of reductions in size and energy consumption and a substantial reduction in time consumption and therefore labour costs during the cleaning, re-equipping and restarting of the machines.

The surface quality of the contact heating rails can be produced by any suitable procedure, for example sandblasting, dull chromium plating or coating, or by treating steels having an austentic structure (V 2 A ) in an acid bath, giving a surface roughness of from 5 to 30 $m\mu$. This procedure has the advantage that the lowest possible frictional resistance is imposed on the false-twist of the filament with the highest possible heat transfer:

The contact heating rail can be heated by a hot liquid, steam or electrical energy. The process is particularly suitable for endless polyamide filaments, and filaments consisting of polyesters or polyacrylonitriles.

An apparatus for carrying out the process is shown in the FIGURE.

A filament 2 is fed to a supply unit 3 of a stretch-texturising machine from a spinning bobbin 1. The filament is stretched in the full drafting ratio between the supply unit 3 and a drafting roller 4. The filament is highly twisted by an internal friction false-twist imparting device 5 and is set on the heated short contact rail 7, which is arranged at a distance of from 150 to 30 mm above the friction twisting unit 5. The making up of the texturised yarn is then effected on a twisting cop 6.

EXAMPLE 1

A polyamide-6 filament (initial count 72.8 f 3 dtex) is drawn between the supply unit and roller in the ratio 1:3.30. The filament speed is 300 m/min. The contact heating rail is adjusted to a temperature of 172° C. The length of the heating rail is 250 mm, the rotation of the twist-imparting unit is 15,000 r.p.m. and the spacing from the heating rail is 80 mm. The filament thus produced has a crimp contraction of 60% and a cold water shrinkage of 55%. The shrinkage on boiling is 8.0% and the final count is dtex 22 f 3.

EXAMPLE 2

A polyamide-66 filament (124 f 9 dtex) is drawn in the ratio 1:3.65, as indicated in Example 1. The filament speed is 330 m/min. The contact heating rail is at a temperature of 190° C and has a length of 200 mm. The speed of the twisting unit is 12,500 r.p.m. The material has a crimp contraction of 65%. The final count is 33 f 9.

What we claim is:

1. An apparatus for the production of a highly elastic crimped yarn by stretch texturising using the false-twist method and setting a synthetic endless filament comprising a supply unit of a stretch-texturising machine, a drafting roller, an internal friction twist-imparting unit and a contact heating rail, the spacing between the twisting unit and the heating rail being between 150 and 30 mm, the heating rail having a roughened contact surface and a length of at most 400 mm and means for separately controlling the speed of the drafting roller and the twist imparting unit being separately controllable.

2. An apparatus according to claim 1 wherein said contact surface of said heating rail has a roughening depth of from 5 to 30 $m\mu$.

* * * * *